US005451843A

United States Patent [19]

Kahn et al.

[11] Patent Number: 5,451,843

[45] Date of Patent: Sep. 19, 1995

[54] APPARATUS AND METHOD FOR PROVIDING BILEVEL ILLUMINATION

[75] Inventors: Michael J. Kahn, Shorewood, Wis.; Bernard Kohanski, Norwich, Conn.

[73] Assignee: Ruud Lighting, Inc., Racine, Wis.

[21] Appl. No.: 231,181

[22] Filed: Apr. 22, 1994

[51] Int. Cl.[6] ..... H05B 37/00

[52] U.S. Cl. ..... 315/186; 315/240; 315/209 R; 315/291; 315/324; 315/DIG. 4

[58] Field of Search ..... 315/186, 187, 209 R, 315/226, 227 R, 231, 240, 291, 324, DIG. 4, 155

[56] References Cited

U.S. PATENT DOCUMENTS

| | | | |
|---|---|---|---|
| 3,433,887 | 3/1969 | Driskell | 174/63 |
| 3,872,350 | 3/1975 | Powell et al. | 315/104 |
| 3,919,459 | 11/1975 | Van Steenhoven | 174/63 |
| 4,000,406 | 12/1976 | Bhavsar | 240/11.2 R |
| 4,054,790 | 10/1977 | Slaughter | 362/364 |
| 4,144,462 | 3/1979 | Sieron et al. | 315/224 |
| 4,147,962 | 4/1979 | Engel | 315/291 |
| 4,258,293 | 3/1981 | Judge et al. | 315/203 |
| 4,344,071 | 8/1982 | Allen | 340/566 |
| 4,431,948 | 2/1984 | Elder et al. | 315/276 |
| 4,739,188 | 4/1988 | DeCandia et al. | 307/149 |
| 4,873,469 | 10/1989 | Young et al. | 315/155 |
| 4,931,701 | 6/1990 | Carl | 315/240 |
| 5,050,042 | 9/1991 | Richmond et al. | 361/395 |
| 5,138,528 | 8/1992 | Altman et al. | 361/400 |

OTHER PUBLICATIONS

Wide-Lite Zone Mate HID Dimming/Bi-Level Switching Design Manual-21 pages -Apr., 1986.

Wide-Lite Spectra-Lyte High Performance Lighting for Parking Garages-12 pages -May, 1990.

Wide-Lite Bi-Level Lighting Control-15 pages -Jan. 1989.

Hi/Lo Lighting Systems by Day-Brite/Benjamin Thomas Industries, Inc.-8 pages -Feb., 1992.

The Watt Soptter-CI Passive Infrared Sensor-4 pages -Jun., 1993.

Wide-Light Buyers Guide Specification-Grade HID Lighting and Controls-15 pages -Sep. 1988.

*Primary Examiner*—Benny Lee
*Assistant Examiner*—Haissa Philogene
*Attorney, Agent, or Firm*—Jansson & Shupe, Ltd.

[57] ABSTRACT

A lighting fixture has a lamp and a housing for a lamp ballast. In the new fixture for providing bilevel illumination, the housing also contains a control device comprised of a dual capacitor and a "random crossing" relay connected to the capacitor. A single electrical control wire is attached to the relay and extends from the housing to a control module for remotely controlling the level of illumination consumed by the fixture. In a system employing one or more of the new fixtures, the level of illumination provided by each fixture is controlled by applying a signal to the control wire and switching the relay independently of the instantaneous value of the voltage across the relay terminals. A new method for providing two levels of power to the fixtures (and, thus, two levels of illumination) is also disclosed.

13 Claims, 9 Drawing Sheets

FIG.6B
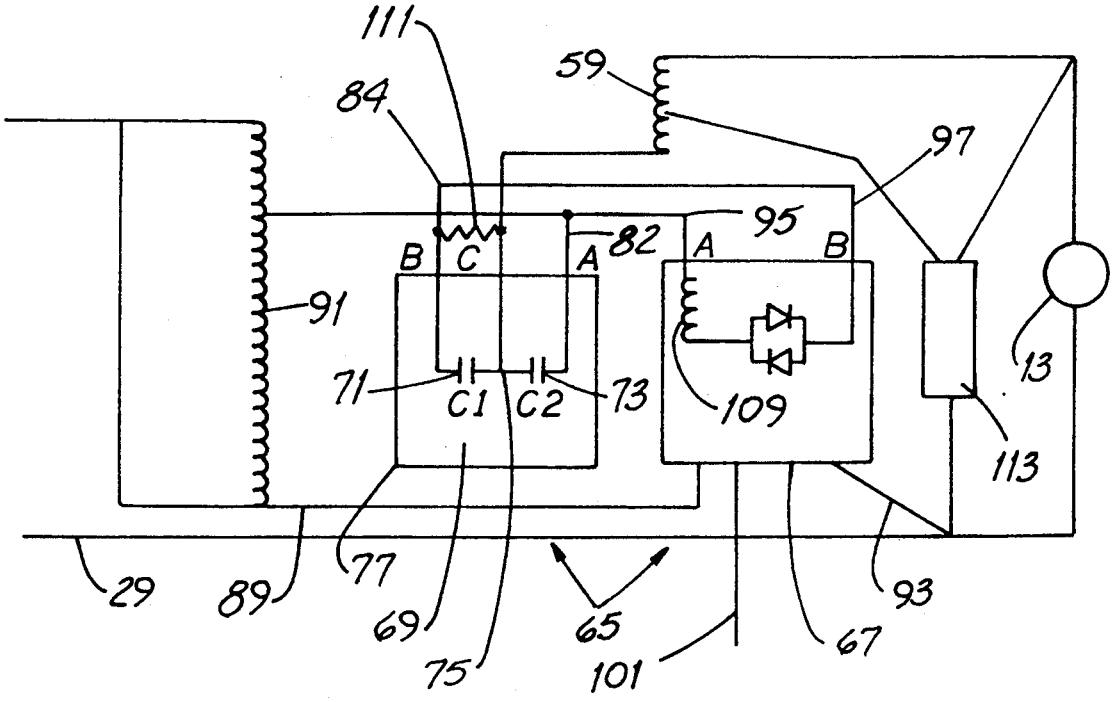
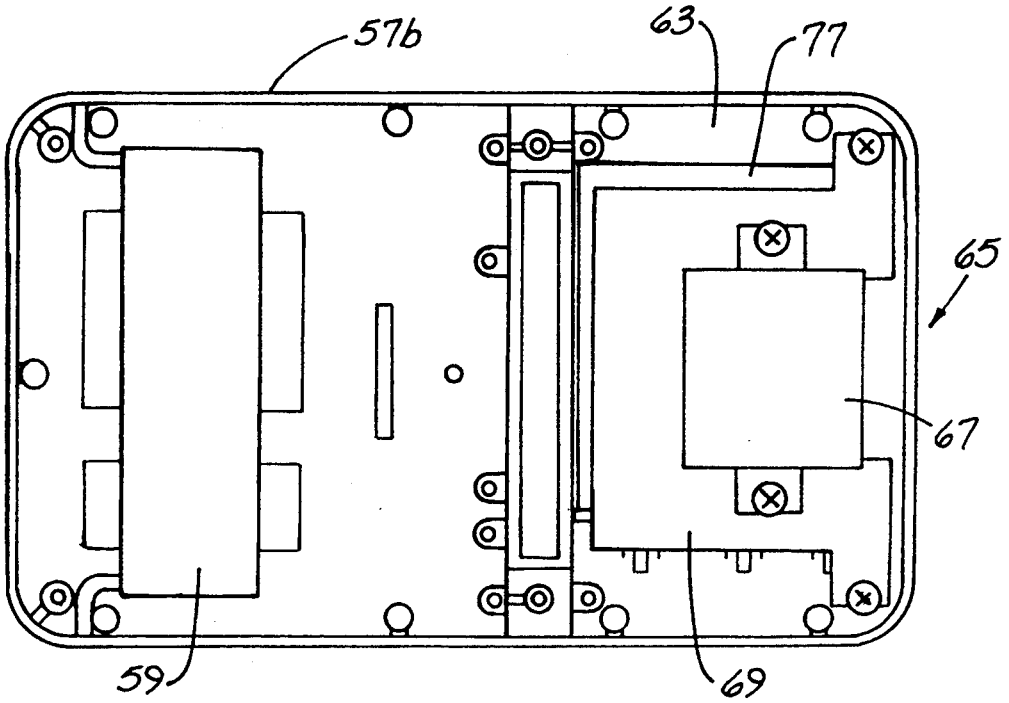
FIG. 3

APPARATUS AND METHOD FOR PROVIDING BILEVEL ILLUMINATION

FIELD OF THE INVENTION

This invention relates generally to illumination and, more particularly, to bilevel illumination.

BACKGROUND OF THE INVENTION

So-called bilevel lighting systems have been in use at least since the early 1970's. Earlier systems involved dimming devices which were preset at a desired reduced level of power and then the control was manually switched between full power and the pre-selected level of reduced power. A later refinement involved more automatic control and took ambient light level into account. Various patents and trade literature relating to bilevel lighting systems are discussed below.

The 1990 Wide-Lite Buyer's Guide depicts a bilevel lighting system. In such system, switching between power levels is by a two-wire control circuit. Such Guide indicates that luminaires can be provided with factory-installed ballasts and switching devices; for retrofits, a remote ballast and, presumably, a remote switching device are used. And the ballast and switching device are described as being in a housing "for heat transfer." The photos accompanying the description suggest that for a luminaire-mounted ballast and switching device, the mentioned housing is separate from and in addition to any housing which is part of the luminaire. There is also indication in the Wide-Lite Buyer's Guide that the ballast used in bilevel lighting systems differs in some way from ballasts used in conventional "on-off" systems.

And in the Wide-Lite bilevel lighting system using metal halide lamps, only 120 VAC control power may be used. Further, such bilevel systems with metal halide lamps need a contactor.

U.S. Pat. Nos. 4,147,962 (Engel); 4,344,701 (Allen) and 4,431,948 (Elder et al.) also depict systems for providing two levels of light output from a lamp. And other systems have emerged, among them a bilevel lighting system shown in U.S. Pat. No. 4,931,701 (Carl). The system depicted in the Carl patent uses a zero crossing relay.

Such earlier systems involve varying degrees of complexity in manufacture and when they are being installed. For example, a system described in trade literature by Day-Brite/Benjamin uses a power line carrier (PLC), a higher-frequency signal superimposed on the 60 Hz AC lines to transmit control signals between a transmitter (which is often coupled with an occupancy detector) and a receiver. In the Day-Brite/Benjamin system, the receiver is on the fixture and there is a phase coupler between the transmitter and receiver to assure that the propagated signal is applied to all three phases of a three-phase system. While PLC systems need no extra control wire, the inclusion of the transmitter, receiver and phase coupler makes then inherently complex.

While there prior art systems have been generally satisfactory for their intended purpose, they have certain disadvantages. To reiterate some of these disadvantages, the PLC system described above requires transmitters, receivers and phase couplers for operation. Other types of bilevel systems require special ballasts configured for the application. Still other types of such systems require plural control wires to effect switching, have certain limitations on control voltage when used with metal halide lamps and require contactors when used with such lamps.

An improved bilevel system overcoming some of these problems and shortcomings would be a distinct advance in the art.

OBJECTS OF THE INVENTION

It is an object of this invention to provide an improved bilevel lighting fixture, system and method overcoming some of the problems and shortcomings of the prior art.

Another object of the invention is to provide an improved lighting fixture suitable for use in a bilevel lighting system.

Yet another object of the invention is to provide an improved bilevel lighting system utilizing the new fixture.

Still another object of the invention is to provide a lighting system which can dramatically reduce the overall level of electrical power consumed thereby.

Another object of the invention is to provide a bilevel lighting fixture using many standard off-the-shelf housing components.

Still another object of the invention is to provide a bilevel lighting system which is typically easier and less expensive to install that current competitive systems.

Another object of the invention is to provide a bilevel lighting system adapted to operate on a voltage within a wide range of control voltages.

Another object of the invention is to provide a bilevel lighting system which is contactor-free, even with metal halide lamps.

Yet another object of the invention is to provide an improved bilevel lighting system which is highly reliable.

Another object of the invention is to provide an improved bilevel lighting system which is less expensive to purchase than some other types of such systems.

Another object of the invention is to provide an improved method for operating a bilevel lighting system.

How these and other objects are accomplished will become more apparent from the following descriptions and from the drawing.

SUMMARY OF THE INVENTION

The invention relates to what is known generally as a bilevel lighting system which provides two different levels of illumination, depending upon the level of electrical power consumed by fixtures within such system. When operated at the lower illumination level, the inventive system reduces the level of power to the fixtures to a level as low as 37% of rated power, depending upon the type and wattage of lamp being used. The resulting opportunity for energy saving is apparent.

The fundamental approach of the inventive system involves using two capacitors with a particular lamp and ballast. A switching arrangement for high pressure sodium lamps places the capacitors in parallel for high level power (and illumination) and removes one of the capacitors from the lamp circuit for reduced power. In a switching arrangement for metal halide lamps, one of the two capacitors is short circuited for high level power and the capacitors are connected in series for reduced power. Very significant amounts of electrical energy can be conserved by using such systems.

An aspect of the invention involves a lighting fixture having a lamp and a housing for a lamp ballast. In a preferred embodiment, the housing also contains a control device connected to the lamp. Such device includes a relay and a pair of capacitors.

A single electrical control conductor is attached to the control device and extends from the housing for remotely controlling the electrical power to the fixture. When a signal is present on the conductor, the fixture is in a high power mode and when such signal is removed, the fixture changes to a lower power mode.

Earlier in this specification, known two wire bilevel control systems (as well as systems of other types) were mentioned. Insofar as is known, a bilevel lighting system controlled using only a single wire is new and accounts in part for the ease of installation and use of the invention. And a quick-disconnect sensor coupler also aids installation of sensor-controlled systems.

Considered another way, the control conductor has a binary signal applied thereto. When the signal is at one "state," i.e., "high," the fixture is in a full power mode. On the other hand, when the binary signal is at the other state, i.e., low (at or near zero voltage), the fixture is in a reduced power mode. In the embodiment depicted herein, the binary signal used for control has a high value in the range of about 100–380 VAC (a very wide range) and a low value of zero or thereabouts. As used in this specification, such binary signal is said to be "applied" to the control conductor even though the value of the signal is zero essentially so when the fixture is in the reduced power mode.

In other aspects, the control device includes a switching relay of the random crossing type. The relay is connected to and switches one of the capacitors into or out of the circuit. Such switching is irrespective of the instantaneous value of voltage across the switched terminals of the relay.

The control device also includes an inductor, a terminal of which is connected to a capacitor. Such inductor attenuates voltage "spikes" that can occur when the relay is switched and voltage attenuation has the effect of limiting surge current.

In another aspect of the invention, the control conductor extends from the housing to a remotely-mounted switching control module. Such module selectively applies a signal (preferably a binary voltage signal) to the conductor and thence to the housing-contained control device, thereby controlling the power consumed by the fixture.

The control module may be of the "timekeeping" type (which causes the system to switch between power modes at predetermined times) or it may be of the occupancy-detecting type. In the latter type, the system fixtures are "powered up" to full power only when an occupant is detected (by an infrared sensor or the like) in the illuminated space.

Other possibilities for the control module include illumination-detection whereby a fixture switches to full brilliance only when ambient illumination (from sunlight or the like) diminishes to a predetermined level and an occupant is detected in the zone. Or the control module may include only an ambient illumination detecting photocell. Additionally, the control module can be configured to interface with a building energy management system or even a manual switch can be used to control fixture power on demand.

Other aspects of the invention involve a system employing a plurality of lighting fixtures and a control module coupled to the fixtures for providing two levels of electrical power to the fixture. The module has a main control unit and a power pack connected together by quick-disconnect coupling, thus adding to the ease with which the system can be installed.

Another aspect of the invention involves a method for providing two levels of power to a system illuminating an area. Such system uses an electrical distribution network having a common line, at least one phase line or, often, three phase lines. The method includes the steps of connecting an electrical conductor between the control module and the fixture and applying a binary signal to the control conductor.

In one specific arrangement, the control module is of the occupancy-sensing type and the signal-applying step is preceded by the step of detecting an occupant within the area. In another specific arrangement, the control module keeps actual time and has at least one setpoint time entered in it, i.e., a time at which the user has predetermined that the system should be operated at full power or at reduced power.

As an example of the latter approach, the system may be configured using a photocell illumination detector to energize the lamps at reduced power at dusk. A timer switches the lamps to full power between, say, 5:00 PM–8:00 PM, and back to reduced power (as security lighting) until, say, dawn when increasing ambient illumination is detected and the fixtures are subsequently switched off. With the timer, the control signal is applied to the conductor (or removed from the conductor if the lights are to be "powered down" at the setpoint time) when the actual time is coincident with the setpoint time. In yet another approach, the control module includes a switch and the state-changing step includes manually operating the switch.

In the method, the distribution system provides sinusoidal AC voltage. The signal-applying step is followed by the step of changing the state of the relay independently of the instantaneous value of the voltage at the switched relay terminals.

BRIEF DESCRIPTION OF THE DRAWING

FIG. 3 is a top plan view of a portion of the housing shown in FIG. 2 taken along the viewing plane 3—3 thereof.

FIG. 6B is a schematic circuit diagram of the control device of the system of FIG. 1 shown in conjunction with a ballast, an igniter and a lamp. The diagram applies to systems used with high pressure sodium lamps.

DETAILED DESCRIPTION OF PREFERRED EMBODIMENTS

Figure 1:
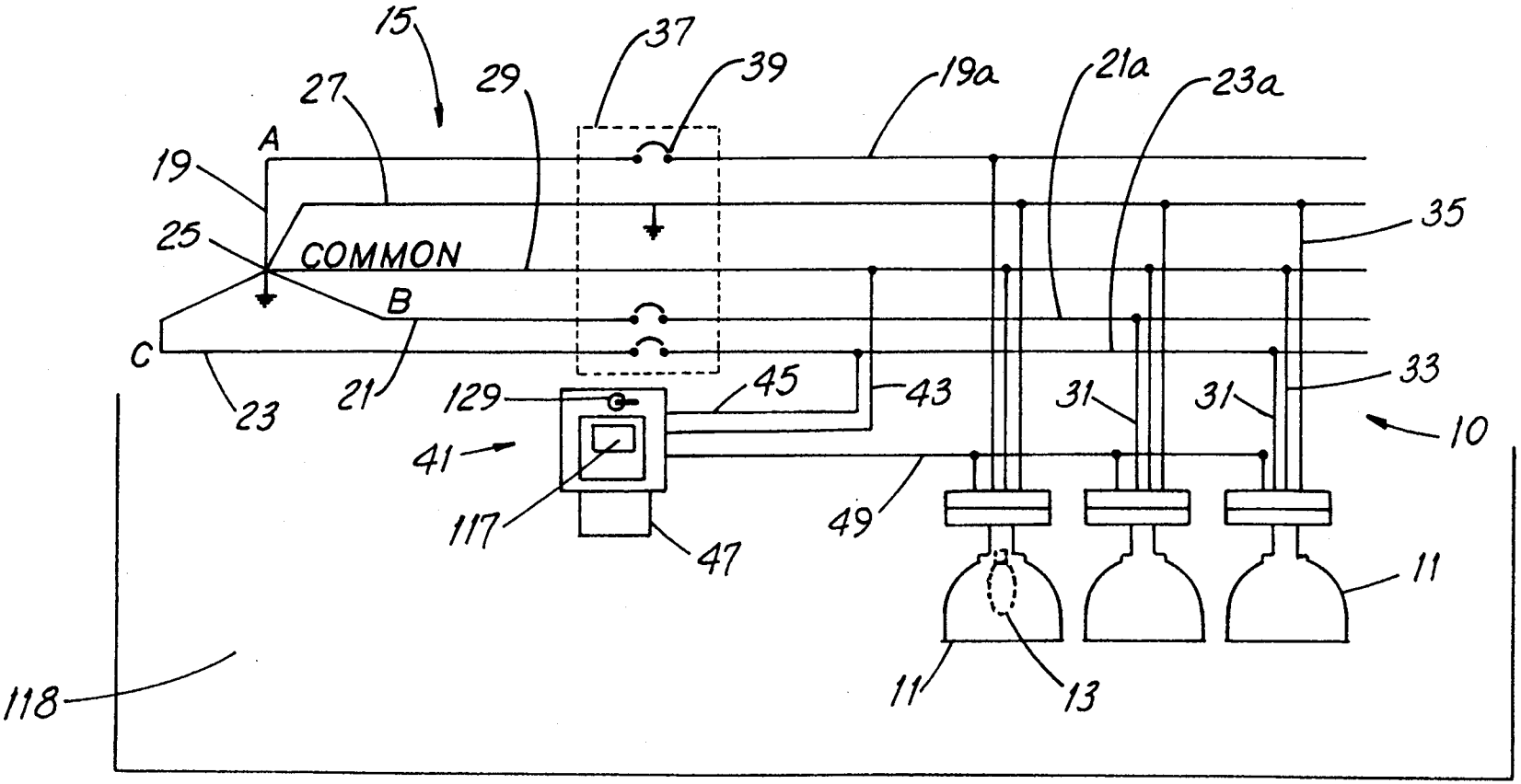
FIG. 1 is a pictorial schematic circuit diagram of a bilevel lighting system incorporating inventive features.

Referring first to FIG. 1, the invention involves a unique lighting system 10 of the type generally referred to as a bilevel lighting system. Systems of this type provide two different levels of illumination, depending upon the level of electrical power consumed by the system lighting fixtures 11. The invention is particularly well suited for fixtures 11 equipped with lamps 13 of the high intensity discharge (HID) type, e.g., mercury, metal halide (MH) or high pressure sodium (HPS) lamps.

The system 10 of FIG. 1 is supplied by an electrical distribution network 15 with an exemplary three-phase transformer having a wye-connected winding 17 at its output side. Such winding 17 has A, B and C phases 19, 21 and 23, respectively, a grounded neutral 25, a ground lead 27 and a common lead 29 extending from the neutral 25. Exemplary phase-to-neutral voltages may be 120 V, 277 V, 347 V (all at 60 Hz) or 230 V at 50 Hz. (It is to be appreciated that the new fixtures 11 and systems 10 using such fixtures 11 need not be applied exclusively to polyphase distribution networks. They are equally applicable to single phase networks.)

Each of a plurality of lighting fixtures 11 is connected to phase lines 19*a*, 21*a*, 23*a* of the distribution network 15 by a phase input lead 31, a common input lead 33 and a ground input lead 35. It should be appreciated that each of the three illustrated fixtures 11 has its phase input lead 31 connected to a different phase line 19*a*, 21*a*, 23*a* and, thus, to a different phase 19, 21, 23 of the winding 17. This is not a requirement of the inventive system 10 in which fixtures 11 can be connected randomly to phase lines 19*a*, 21*a*, 23*a*. Rather, FIG. 1 merely illustrates the accepted practice of approximately balancing the load imposed upon each phase of a transformer.

Interposed between the winding 17 and the fixtures 11 is a disconnect panel 37 having one pole of a switching mechanism 39, e.g., a circuit breaker, in series with each phase line 19*a*, 21*a*, 23*a*. The mechanism 39 is opened to disconnect all power from the fixtures 11 and closed when illumination (whether high or low level) is desired.

The system 10 also includes a control module 41 having a common lead 43 connected to the common lead 29 of the distribution network 15. There is also one lead 45 connected to a phase line on the load side of the mechanism 39 (e.g., connected to line 23*a* in the drawing) for providing voltage to the module power pack 47, the latter used only for a sensor-controlled system 10. (The particular phase line 19*a*, 21*a*, 23*a* selected for the purpose is usually immaterial since the control module 41 consumes very little power.)

A single control wire 49 extends between each fixture 11 and the module 41 and as described in more detail below, such wire 49 is used to control the level of electrical power consumed by each fixture 11. All fixtures 11 connected to a particular module 41 are controlled in unison and will operate at the same power level, i.e., high or low.

On the other hand, two or more such systems 10 are often employed to illuminate a particular area, especially a larger area such as a warehouse. Each such system 10 is independently controlled by its own control module 41 and can be used to provide bilevel illumination within any one of several smaller "zones" where people may be working within the larger area. From an energy conservation standpoint, the invention is particularly advantageous where persons are moving from zone to zone—the installation can be configured and controlled so that only the occupied zone is illuminated.

Figure 2:
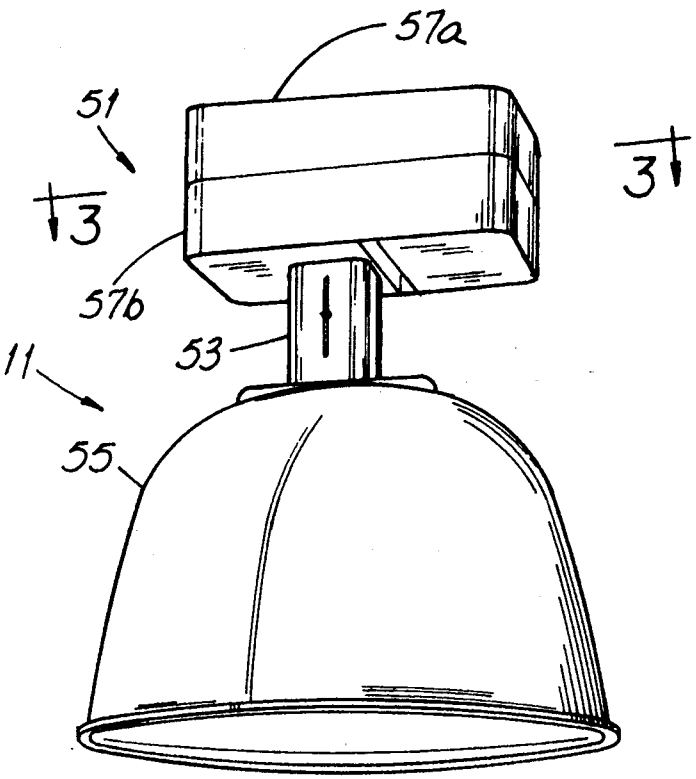
FIG. 2 is a perspective view of a high bay lighting fixture, an exemplary type of fixture useful with the system of FIG. 1.

FIGS. 2, 3, 4 and 5 show aspects of standard fixture housings made by Ruud Lighting, Inc., Racine, Wis., the leading manufacturer of industrial and commercial lighting fixtures and the assignee of the invention. FIGS. 2 and 3 depict what is known as a high bay fixture 11. Such fixture 11 includes the main housing 51, a neck housing 53 and a reflector 55 attached to and suspended from the neck housing 53.

Figure 6A:
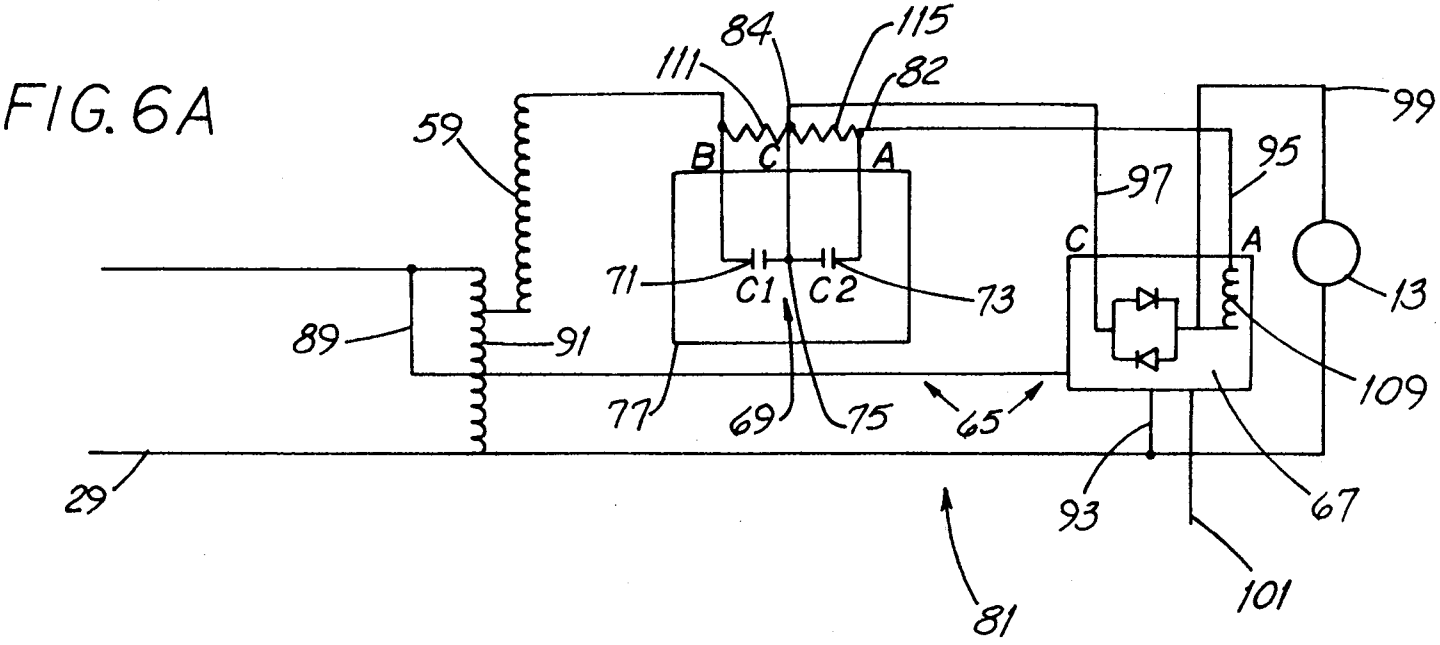
FIG. 6A is a schematic circuit diagram of the control device of the system of FIG. 1 shown in conjunction with a ballast and a lamp. The diagram applies to systems used with metal halide lamps.

The main housing 51 has two identical housing portions, namely, an upper portion 57*a* inverted atop the lower portion 57*b* to define an enclosed space. As shown in FIGS. 3, 6A and 6B, a conventional ballast 59 is installed in the cell 61 and, in a non-bilevel fixture, a single capacitor is installed in the cell 63.

In the invention, cell 63 has a control device 65 which includes a relay 67 bracket-mounted adjacent to a dual capacitor 69, i.e., two separate capacitors 71, 73 having one common terminal 75 and assembled within a cylinder-like common container 77. The dual capacitor 69 is much more convenient to use than two separate capacitors as used in known systems. In a specific embodiment for a 400 watt HPS fixture, the capacitor 71 (also identified as C1) is 20 microfarads and the capacitor 73 (also identified as C2) is 35 microfarads. For a 400 watt MH fixture, the capacitor 71 is 24 microfarads and the capacitor 73 is 38 microfarads. And one of ordinary skill in the art will recognize that other capacitor combinations may be used with other lamp wattages and other types of lamps, e.g., mercury vapor lamps.

Figure 4:
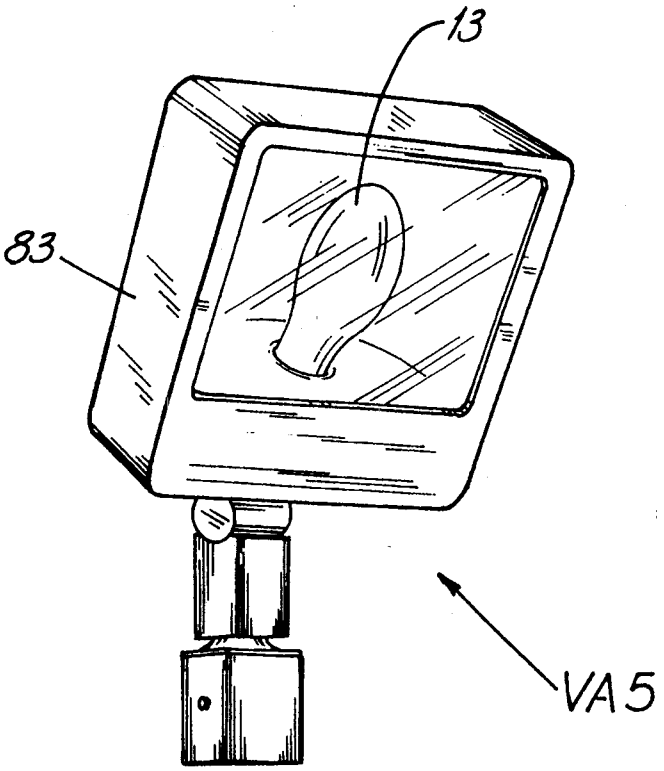
FIG. 4 is a perspective view of a floodlight lighting fixture, another exemplary type of fixture useful with the system of FIG. 1.
Figure 5:
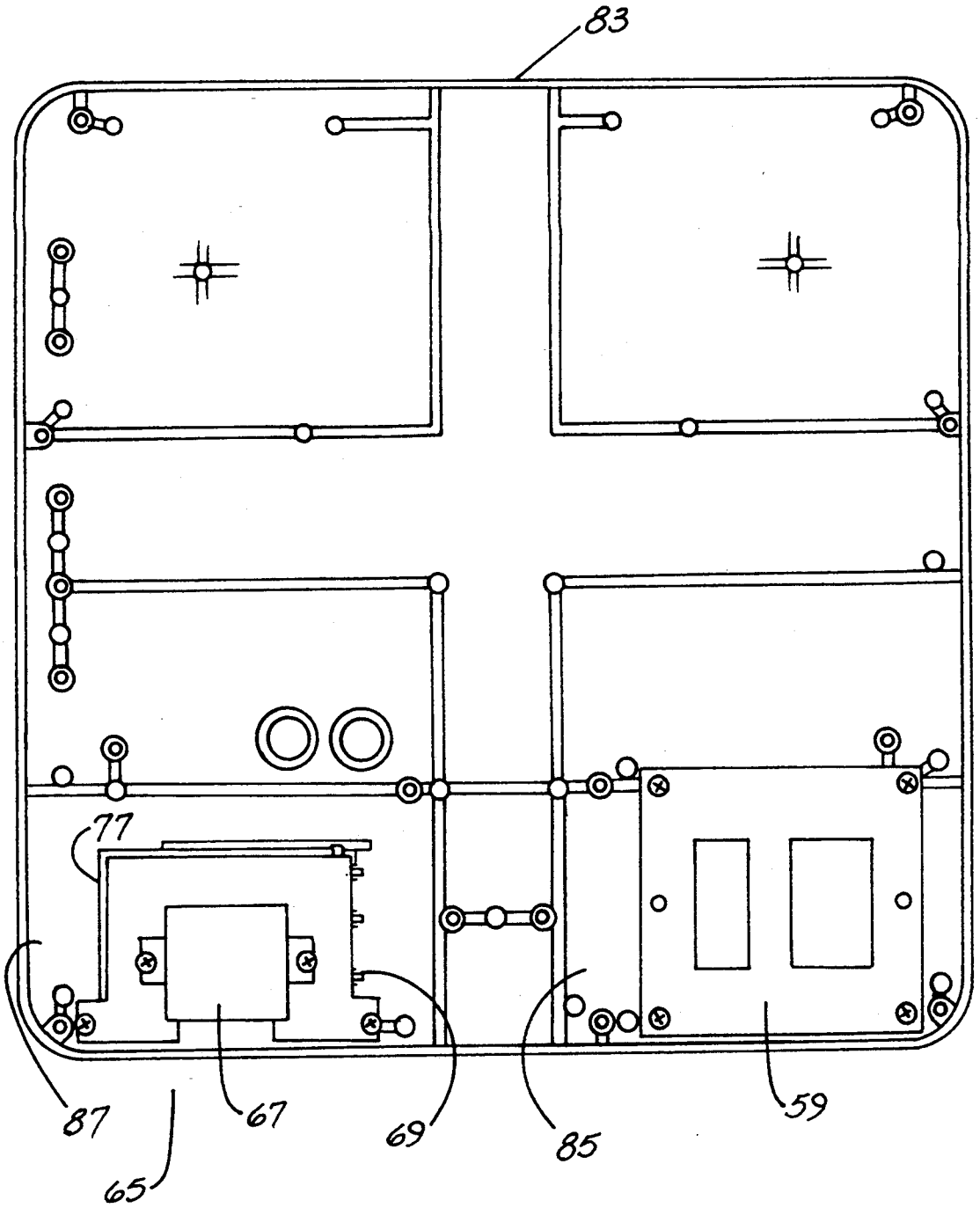
FIG. 5 is a view of the floodlight housing shown in FIG. 4 taken along the viewing axis VA5 thereof with cover, reflector and lamp removed.

The housing 83 shown in FIGS. 4 and 5 is used for floodlights. A conventional ballast 59 is installed in the cell 85 and, in a non-bilevel fixture, a single capacitor is installed in the cell 87. In the invention, the cell 87 has a control device 65 which, as with the portion 57*b* of FIG. 3, includes a relay 67 bracket-mounted adjacent to a dual capacitor 69. From the foregoing, it will be appreciated that the invention can be used with a wide variety of housing types.

Figure 7:
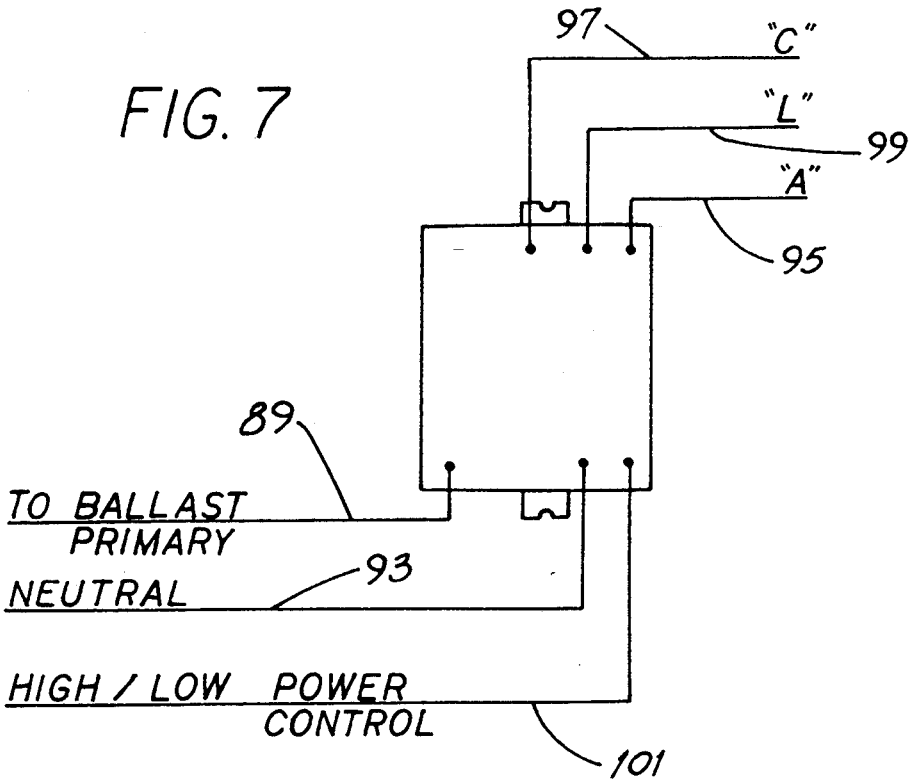
FIG. 7 is a simplified diagram of the relay portion of the control device of FIG. 6.
Figure 8A:
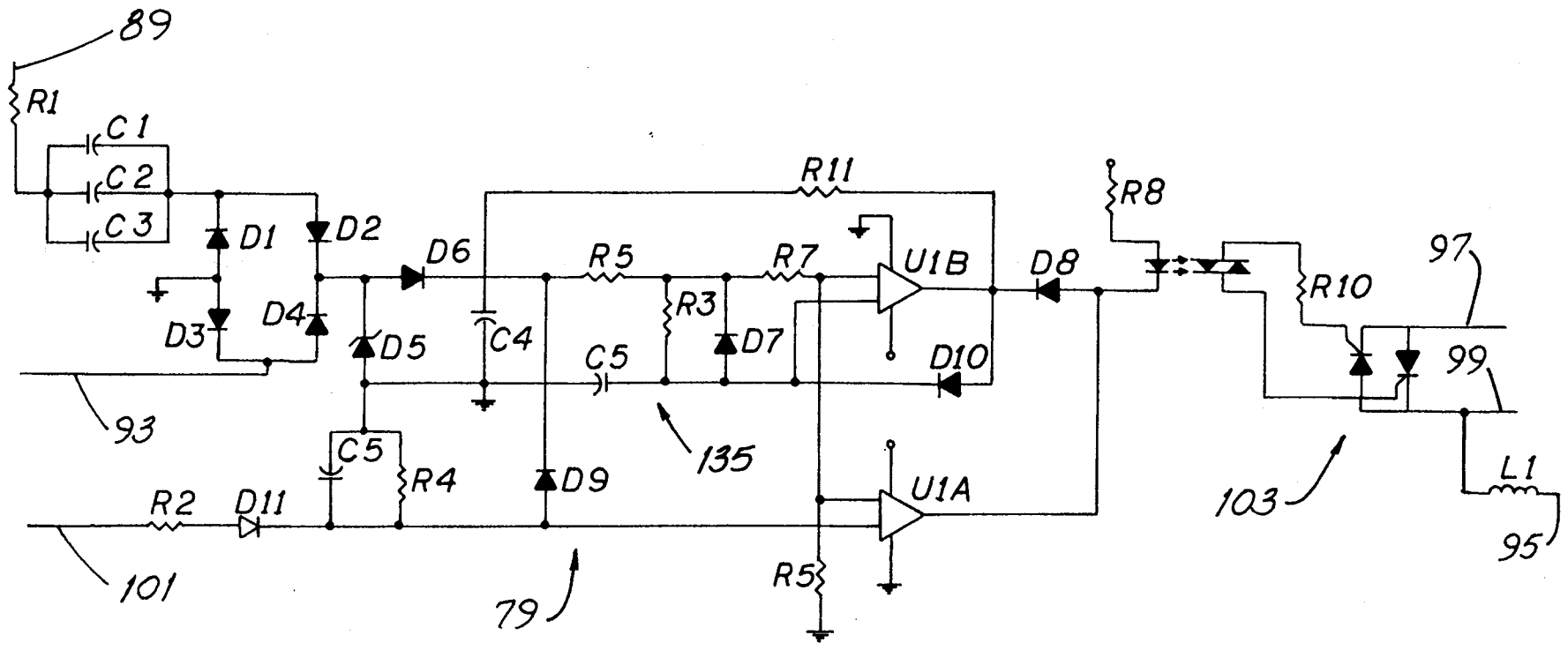
FIG. 8A is a schematic circuit diagram of one embodiment of the relay portion shown in FIG. 7 as applied to systems used with metal halide lamps.
Figure 8B:
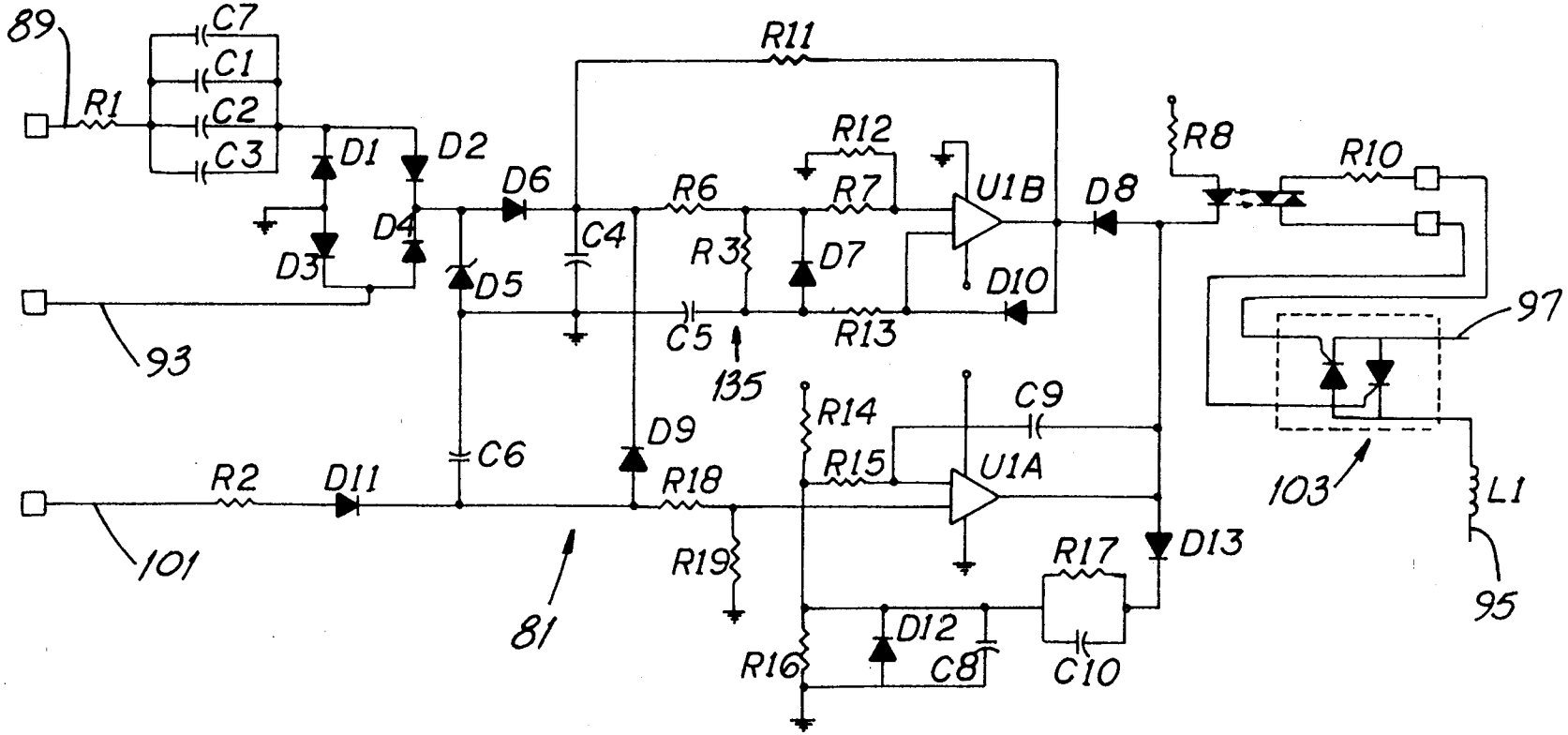
FIG. 8B is a schematic circuit diagram of another embodiment of the relay portion shown in FIG. 7 as applied to systems used with high pressure sodium lamps.

The exterior arrangement of the relay 67 is shown generally in FIG. 7 and the relay internal circuits 79, 81 (for metal halide and high pressure sodium lamps, respectively) are shown in FIGS. 8A and 8B, respectively. When installed, line 89 is connected to the ballast primary 91, line 93 to common 29 of the supply, line 95 to capacitor terminal 82, line 97 to capacitor terminal 84 and (in the circuit 79 of FIG. 8A for metal halide lamps) line 99 to the lamp 13. The control conductor 101 is connected to the control wire 49 and is used for relay switching as described below. The circuit of FIG. 8B (for high pressure sodium lamps) has no line corresponding to line 99 and such omission should be appreciated when considering FIG. 7.

Preferably, the relay 67 is of the solid state type having a pair of silicon-controlled rectifiers 103 which can be switched between a conducting and a non-conducting state. The new system 10 involves using two capacitors 71, 73 with a particular fixture lamp 13. As is apparent from an inspection of FIGS. 6A or 6B, when the relay 67 is in a conducting state, the capacitors 71, 73 are connected in parallel and the power consumed by the lamp 13 is at rated value. When the relay 67 is in a non-conducting state, capacitor 71 is disconnected from the lamp circuit.

(Persons of ordinary skill in the art will recognize that when two capacitors are in parallel, the resulting capacitance is the sum of their individual capacitances. In the system 10, increased capacitance—up to a "ceiling" value—results in increased power being consumed by the lamp.)

The single electrical control conductor 101 is attached to the control device 65, extends from the housing 51 or 83 and is coupled to the control wire 49 of the module 41 for remotely controlling the voltage applied to the relay 67 via conductor 101. Thus, the relay 67 controls the power consumed by the fixture 11. When the module 41 provides a binary "high" signal on the wire 49 and the conductor 101, the fixture 11 is in a high power mode and when such signal is "low," i.e., at or near zero volts, the fixture 11 changes to a lower power mode.

In other aspects of the invention, the relay 67 is of the random crossing type. That is, the relay 67 is switched without regard for the instantaneous value of AC voltage across its switched or output terminals. As mentioned in the background of this specification, the arrangement depicted in the Carl patent uses a zero crossing relay. Insofar as is known, a random crossing relay 67 in a bilevel lighting system is new.

Referring further to FIGS. 6A and 6B, the control device 65 also includes an inductor 109 or "choke," a terminal of which is connected to the capacitor 73. Such inductor 109 attenuates voltage "spikes" that can occur when the relay 67 is switched; voltage attenuation has the effect of limiting relay surge current.

Capacitors are electrical energy storage devices and over time (and when used in the inventive system 10) such capacitors tend to lose their stored energy or "charge." However, if the system 10 is switched rather rapidly between high and low power modes, there may not be time for capacitor stored energy to dissipate. Therefore, it is advisable to equip at least one capacitor (capacitor 71) with a bleed resistor 111 connected in parallel therewith for more quickly dissipating energy stored in such capacitor 71. This arrangement enhances reliability.

In the circuit of FIG. 6B for an HPS lamp, an ignitor 113 is included and functions as a bleed resistor with respect to the capacitor 73. Therefore, only a single bleed resistor 111 is used and it is connected across capacitor 71. On the other hand, when the circuit is used with an MH lamp, no ignitor is used. In that instance, a second bleed resistor 115 is connected across capacitor 73.

Figure 9:
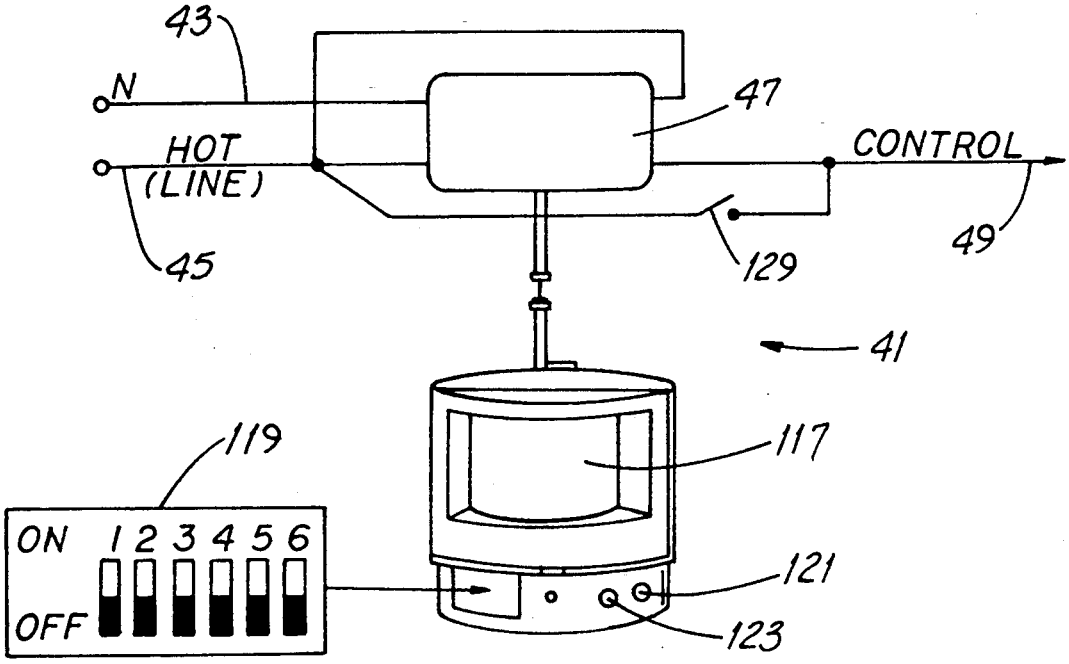
FIG. 9 is a pictorial schematic diagram of a control module of the occupancy-sensing type.

Referring again to FIG. 1 and additionally to FIG. 9, one embodiment of the control module 41 has a passive infrared sensor panel 117 which scans substantially continuously and detects changes in infrared heat radiated within the area 118 being monitored. For example, if a human enters such area 118, the panel 117 detects body heat. When heat is detected, the control module 41 causes the binary signal to be high and voltage (preferably in the range of 100–380 VAC) is applied to the control wire 49 and, therefore, to each fixture 11 connected to that module 41. The fixtures 11 are thereby brought to their rated power and illumination levels. After appreciating this specification, persons of ordinary skill will understand how, for example, an ultrasonic sensor can be used.

A six-position DIP switch 119 is provided to permit introducing a time delay between the time at which a change in heat is last detected and the time at which the fixtures 11 are returned to their low power level. In a specific embodiment, such time delay is adjustable between a few seconds and about 30 minutes. To put it another way, the time delay maintains the fixtures 11 at rated power for anywhere from a few seconds to 30 minutes after the last scan on which a person is detected.

The sensor module 41 also has an ambient light level adjustment 121 and a sensitivity adjustment 123. The former can be used to prevent fixtures 11 controlled by that module 41 from being switched to full power if natural light levels are above a user-specified level. In a specific embodiment, this level is adjustable from about 2.5 to over 400 footcandles. Significantly, no wiring changes are required to utilize this function. An override switch 129 is manually operable to bring the fixture(s) 11 to full power on demand.

Figure 10:
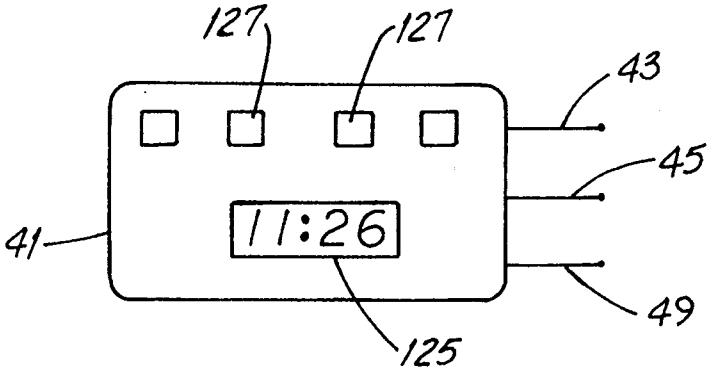
FIG. 10 is a pictorial schematic diagram of a control module of the timekeeping type.

As shown in FIG. 10 the control module 41 may also be of the "timekeeping" type which causes the system 10 to switch between power modes at predetermined times and/or during predetermined days of the week. The module 41 of FIG. 10 has a display panel 125 and buttons 127 or the like for programming the module 41 for the time period(s) during which the fixtures 11 will be at rated power and provide rated illumination.

Figure 11:
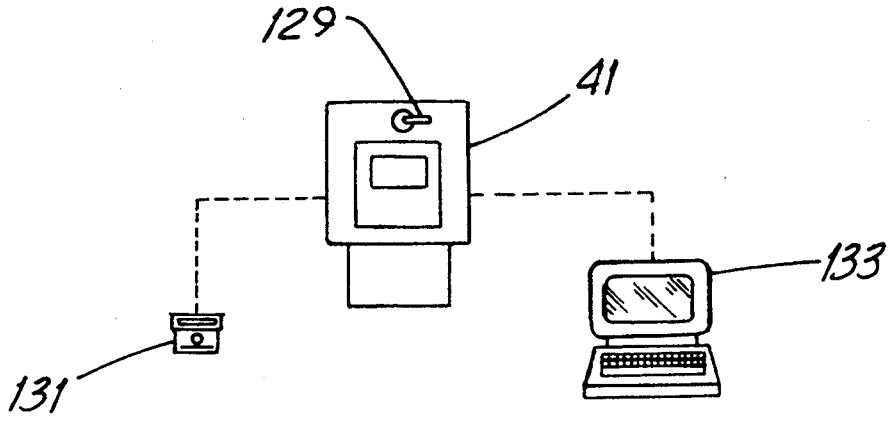
FIG. 11 is a composite pictorial diagram illustrating a control module interfaced with a photocell and/or an energy management system.

FIG. 11 shows how the module 41 may be used with a photocell 131 and/or an energy management system 133 as mentioned above. The photocell 131 is that device used to detect an ambient light level while the energy management system 133 is computerized for illumination, HVAC control, security and other functions. Photocells and energy management systems, per se, are known.

The invention also involves a method for controlling two levels of power to a system 10 illuminating an area. The method including the steps of connecting an electrical conductor 101 between the control module 41 and the fixture 11 and changing the state of the binary signal on the conductor 101. In a more specific version of the method, the control module 41 is of the occupancy-sensing type (as shown in FIG. 9) and the state-changing step is preceded by the step of detecting an occupant within the area 118.

In another more specific version, the control module 41 (shown in FIG. 10) keeps actual time and has at least one setpoint time entered therein. In this variant of the method, the state of the conductor 101 binary signal is changed when the actual time is coincident with the setpoint time.

The distribution network 15 provides sinusoidal AC voltage and the fixture 11 includes the relay 67 shown in FIGS. 6–8 which is switched between a non-conducting state and a conducting state. The state-changing step is followed by the step of changing the state of the relay 67 independently of the instantaneous value of the voltage at the switched relay terminals.

As noted above, typical HID lamps must be cold-started at rated power for a period of time. In another aspect of the invention, the timing circuitry which causes such rated power starting is incorporated into the fixture-mounted relay 67 rather than into a remotely mounted, multi-fixture "master" timing circuit as with prior art arrangements. The inventive arrangement provides a subtle but very important advantage.

If a relay timing circuit malfunctions, only the particular fixture 11 in which that relay 67 is mounted will exhibit greatly reduced lamp life. In certain prior art systems, a failure of the master timing circuit causes an entire "bank" of fixtures to exhibit greatly reduced lamp life.

The timing circuit 135 is shown in FIGS. 8A and 8B and includes the capacitor C5, initially at zero charge. While the capacitor C5 is charging, the output pin of U1B is effectively grounded, the optocoupler conducts and the fixture is operated at rated power.

The rate at which the capacitor C5 charges is governed by the resistor R3 and a value is selected so that the charging time is about 8–14 minutes. When the charge of capacitor C5 is such that the voltage on the pin of amplifier U1B to which capacitor C5 is connected rises above the voltage on the pin of amplifier U1B to which resistor R7 is connected, the optocoupler is extinguished and the fixture switches to reduced power operation so long as the control module 41 is in the "low" state.

In the relay 67 of FIG. 8A for metal halide lamps, the following components may be used:

| COMPONENT | VALUE/TYPE |
|---|---|
| R1 | 510 |
| C1, C2, C3 | 047 mf |
| D1, D2, D3, D4, D6, D7 D8, D9, D10 AND D11 | 1N4007 |
| R11, R5 | 10K |
| R8 | 2.2K |
| D5 | 1N4762 |
| C4 | 22 mf |
| R6 | 6.2K |
| R3 | 1M |
| R7 | 1K |
| C5 | 220 mf |
| R10 | 100 |
| R2 | 330K |
| C6 | .1 mf |
| R4 | 560K |

In the relay 67 of FIG. 8B for high pressure sodium lamps, the following components may be used:

| COMPONENT | VALUE/TYPE |
|---|---|
| R1 | 510 |
| C1, C2, C3, C7 AND C9 | 0.47 mf |
| D1, D2, D3, D4, D6, D7, D8, D9, D10, D11, D12 AND D13 | 1N4007 |
| D5 | 1N4762 |
| C4 | 22 mf |
| R11 | 10K |
| R12 | 10K |
| R8 | 2.2K |
| R10 | 100 |
| R6 | 6.2K |
| R3 | 1.2M |
| R7 | 1K |

-continued

| COMPONENT | VALUE/TYPE |
|---|---|
| C5 | 220 mf |
| R13 | 27K |
| R2, R18 AND R19 | 330K |
| C6 | .1 mf |
| R14 | 4.7M |
| R15 | 550K |
| R16 | 1M |
| C8 | 4.7 mf |
| R17 | 4.7M |
| C10 | 22 mf |

While the principles of the invention have been shown in connection with specific embodiments, it is to be understood clearly that such embodiments are by way of example and are not limiting.

We claim:

1. In a bilevel lighting fixture having a lamp and a housing for a lamp ballast, the improvement wherein:

the housing contains a control device coupled to the lamp by fixture wiring; and a single electrical conductor is attached to the control device and extends from the housing to a control location remote from the fixture for remotely controlling the electrical power to the fixture.

2. The fixture of claim 1 wherein the control device includes a random crossing switching relay, the conductive state of which is controlled by the conductor.

3. The fixture of claim 2 wherein:

the relay has output terminals;

the relay is switched by a binary signal on the conductor and irrespective of the voltage across the output terminals.

4. The fixture of claim 2 wherein:

the relay includes a timing circuit; and the timing circuit causes the fixture to be operated at full power for a predetermined time upon initial fixture startup.

5. The fixture of claim 1 wherein:

the power consumed by the fixture is controlled by a binary signal applied to the conductor;

the conductor extends from the housing to a remotely-mounted module; and the module changes the state of the binary signal, thereby controlling the power consumed by the fixture.

6. In a bilevel lighting system employing a plurality of lighting fixtures and a module remote from the fixtures for controlling the level of electrical power consumed by each fixture, the improvement wherein:

each fixture includes a random crossing relay;

the module is connected to each fixture by an electrical conductor;

each fixture is capable of operating at either of only two levels of illuminating power; the level of power consumed by each fixture is controlled by a conductor binary signal.

7. The system of claim 6 wherein each fixture includes a lamp supported by a housing and wherein:

the relay is secured with respect to the housing and has output terminals switched between non-conducting and conducting states; and the level of power is changed by changing the state of the relay independently of the instantaneous value of the voltage across the terminals.

8. The system of claim 6 wherein:

each of plural fixtures has a housing containing a timing circuit configured to bring the fixture to rated illumination upon initial application of electrical power to the fixture.

9. The system of claim 6 including a module power pack and wherein the module and the power pack are connected to one another by a quick-disconnect coupling.

10. A method for providing two levels of power to a system illuminating an area, the system including (a) at least one lighting fixture having a fixture control relay, and (b) a switching control module, the method including the steps of:

connecting a single electrical conductor between the control module and the fixture control relay for providing a binary signal to the relay; and changing the state of the conductor binary signal.

11. The method of claim 10 wherein the system is powered by sinusoidal AC voltage, the relay has output terminals switched between non-conducting and conducting states and the state-changing step is followed by the step of:

changing the state of the relay independently of the instantaneous value of the voltage across the output terminals.

12. In a system employing a plurality of lighting fixtures and a module for controlling the level of electrical power consumed by each fixture, the improvement wherein:

the module is connected to each fixture by an electrical conductor;

the level of power consumed by each fixture is controlled by a conductor binary signal;

the system includes a module power pack; and the module and the power pack are connected to one another by a quick-disconnect coupling.

13. A method for providing two levels of power to a system illuminating an area using an electrical distribution network having a common line and at least one phase line, the system including at least one lighting fixture and a switching control module which keeps actual time and has at least one setpoint time entered therein, the method including the steps of:

connecting an electrical conductor between the control module and the fixture; and changing the state of the conductor binary signal when the actual time is coincident with the setpoint time.

* * * * *